US007721558B2

(12) United States Patent
Ha et al.

(10) Patent No.: US 7,721,558 B2
(45) Date of Patent: May 25, 2010

(54) MULTI-AIR CONDITIONER AND GROUP-UNIT CONTROL METHOD THEREOF

(75) Inventors: Do Yong Ha, Anyang-si (KR); Ii Nahm Hwang, Yongin-si (KR); Si Kyong Sung, Seoul (KR); Young Min Park, Incheon-si (KR); Won Chul Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 1223 days.

(21) Appl. No.: 11/281,459

(22) Filed: Nov. 18, 2005

(65) Prior Publication Data

US 2006/0123811 A1 Jun. 15, 2006

(30) Foreign Application Priority Data

Dec. 14, 2004 (KR) ..... 10-2004-0105433

(51) Int. Cl.
*F25D 29/00* (2006.01)
*F25B 7/00* (2006.01)
*G05D 23/00* (2006.01)
*F24F 3/00* (2006.01)

(52) U.S. Cl. ..... 62/161; 62/175; 236/51; 165/209

(58) Field of Classification Search ..... 236/51; 62/175, 161; 165/207, 208, 209
See application file for complete search history.

(56) References Cited

U.S. PATENT DOCUMENTS 5,647,223 A * 7/1997 Wada et al. ..... 62/175
6,126,080 A * 10/2000 Wada ..... 236/51
6,755,038 B2 6/2004 Hwang
6,772,600 B2 8/2004 Hwang

FOREIGN PATENT DOCUMENTS

CN 1192523 A 9/1998
JP 07012393 A * 1/1995
KR 1998-032921 7/1998

OTHER PUBLICATIONS

U.S. Appl. No. 11/194,440, filed Aug. 2, 2005, Kim et al.
U.S. Appl. No. 11/194,442, filed Aug. 2, 2005, Park et al.
English Language Abstract of KR 1998-032921.
English Language Abstract of CN 1192523, Sep. 9, 1998.

* cited by examiner

*Primary Examiner*—Chen-Wen Jiang
(74) *Attorney, Agent, or Firm*—McKenna Long & Aldridge LLP

(57) ABSTRACT

Disclosed herein are a multi-air conditioner and a group-unit control method thereof, wherein a plurality of indoor units can be controlled on a group basis. The method comprises the step of grouping the indoor units into a plurality of groups, the step of if an air conditioning operation condition of a specific one of the indoor units is changed, sending, by the specific indoor unit, the changed operation condition to all the other indoor units according to a predefined communication protocol, and the step of by each of the indoor units, receiving an air conditioning operation condition sent from a different one of the indoor units in the same group and performing an air conditioning operation based on the received operation condition. According to the invention, the plurality of indoor units can be more efficiently controlled on a group basis through inter-indoor unit data communication. Further, the group-unit control is not restricted by whether a controller is used or not. Moreover, it is easy to add or change an object to which the group-unit control is to be applied.

18 Claims, 3 Drawing Sheets

MULTI-AIR CONDITIONER AND GROUP-UNIT CONTROL METHOD THEREOF

This application claims the benefit of the Korean Patent Application No. P2004-105433, filed on Dec. 14, 2004, which is hereby incorporated by reference as if fully set forth herein.

BACKGROUND OF THE INVENTION

1. Field of the Invention

The present invention relates to a multi-air conditioner, and more particularly, to a multi-air conditioner and a group-unit control method thereof, wherein a plurality of indoor units can be controlled on a group basis.

2. Discussion of the Related Art

Generally, an air conditioner is a home appliance that cools or heats a residing space or the indoor space of an office or the like.

Nowadays, with the increase in the number of multiple dwelling buildings and large-scale, high-rise buildings, a multi-air conditioner is being increasingly supplied which cools or heats an indoor space partitioned into a plurality of rooms.

This multi-air conditioner consists of one outdoor unit, and a plurality of indoor units connected in common to the outdoor unit and installed respectively in the rooms.

That is, the outdoor unit is used commonly for the indoor units, and the indoor units each operate as a cooler or heater as needed, to perform the air conditioning of the corresponding room.

In order to individually control the indoor units installed respectively in the rooms, a wired/wireless controller must be provided for each of the indoor units to individually control the corresponding indoor unit.

On the other hand, for group-unit control for grouping the indoor units into a plurality of groups and operating each group of indoor units at the same time, a single wired controller must be connected in parallel to all the indoor units of each group.

If air conditioning operation conditions, such as operation ON/OFF, cooling/heating mode, air volume, temperature, etc., are inputted through the wired controller, then all the indoor units of the corresponding group receive the inputted operation conditions and perform the same air conditioning operation based on the received operation conditions at one time.

However, a separate wiring process is required for the parallel connection of one wired controller to the indoor units of each group for the group-unit control of the multi-air conditioner.

Further, it is impossible to perform the group-unit control for an indoor unit which is not connected with the wired controller.

Furthermore, for addition or change of an object, or indoor unit, to which the group-unit control is to be applied, it is necessary to change the wiring for the controller connection.

SUMMARY OF THE INVENTION

Accordingly, the present invention is directed to a multi-air conditioner and a group-unit control method thereof that substantially obviate one or more problems due to limitations and disadvantages of the related art.

An object of the present invention is to provide a multi-air conditioner and a group-unit control method thereof, wherein a plurality of indoor units can be controlled on a group basis irrespective of a wiring process of a controller.

Another object of the present invention is to provide a multi-air conditioner and a group-unit control method thereof, wherein a plurality of indoor units can be more efficiently controlled on a group basis according to a communication protocol between an outdoor unit and each of the indoor units.

Yet another object of the present invention is to provide a multi-air conditioner and a group-unit control method thereof, wherein it is easier to add or change an object to which the group-unit control is to be applied.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a multi-air conditioner comprises one outdoor unit; and a plurality of indoor units connected in common to the outdoor unit via a communication line for performing data communication with the outdoor unit, each of the indoor units acting variably as a master and a slave and performing an air conditioning operation based on the same air conditioning operation conditions on a group basis.

Preferably, the indoor units include a master indoor unit acting as the master if an air conditioning operation condition thereof is changed, the master indoor unit sending the changed operation condition according to a predefined communication protocol; and slave indoor units for receiving the operation condition sent from the master indoor unit through data communication with the master indoor unit and performing an air conditioning operation based on the received operation condition on a group basis.

Preferably, the indoor units are grouped into a plurality of groups, each of the groups including at least one indoor unit having a wired/wireless controller through which a user can personally input the air conditioning operation conditions to the indoor unit.

Preferably, each of the indoor units includes a group designator for assigning a group identification (ID) to a corresponding one of the indoor units so that the corresponding indoor unit can be controlled on a group basis.

The group designator may include any one of a rotary switch or dip switch.

In another aspect of the present invention, there is provided a group-unit control method of a multi-air conditioner, the multi-air conditioner including one outdoor unit, and a plurality of indoor units connected in common to the outdoor unit for performing data communication with the outdoor unit, the method comprising the steps of a) grouping the indoor units into a plurality of groups; b) if an air conditioning operation condition of a specific one of the indoor units is changed, sending, by the specific indoor unit, the changed operation condition to all the other indoor units according to a predefined communication protocol; and c) by each of the indoor units, receiving an air conditioning operation condition sent from a different one of the indoor units in the same group and performing an air conditioning operation based on the received operation condition.

The format of the predefined communication protocol may include an indoor unit ID and group ID of the sending indoor unit, an air conditioning operation condition of the sending indoor unit, and a master bit indicative of whether the operation condition of the sending indoor unit has been changed.

Preferably, the step b) includes the steps of by the specific indoor unit, recognizing itself as a master indoor unit if the operation condition thereof is changed by a user, and then sending communication data to all the other indoor units, the communication data including an indoor unit ID and group ID of the specific indoor unit, the changed operation condition, and a master bit indicative of the operation condition change; and by the specific indoor unit, clearing the master bit after sending the communication data a predetermined number of times.

Preferably, the step b) includes the step of if the operation condition of the specific indoor unit is internally changed during an air conditioning operation of the specific indoor unit, sending, by the specific indoor unit, communication data to all the other indoor units, the communication data including an indoor unit ID and group ID of the specific indoor unit, the changed operation condition, and a master bit indicative of a clear state.

Preferably, the step c) includes the steps of by the receiving indoor unit, receiving communication data including a group ID and changed air conditioning operation condition of the sending indoor unit; and by the receiving indoor unit, performing an air conditioning operation based on the operation condition in the received communication data if the group ID in the received communication data is the same as a group ID of the receiving indoor unit.

Preferably, the step c) includes the steps of by the receiving indoor unit, receiving communication data including an indoor unit ID and group ID of the sending indoor unit, a changed air conditioning operation condition of the sending indoor unit, and a master bit indicative of the operation condition change; and by the receiving indoor unit, storing the indoor unit ID in the received communication data as a master indoor unit ID if the group ID in the received communication data is the same as a group ID of the receiving indoor unit and the master bit indicates the operation condition change, and then performing an air conditioning operation based on the operation condition in the received communication data.

Preferably, the step c) includes the steps of by the receiving indoor unit, receiving communication data including an indoor unit ID and group ID of the sending indoor unit, a changed air conditioning operation condition of the sending indoor unit, and a master bit indicative of a clear state; by the receiving indoor unit, determining whether the master bit indicates the clear state, if the group ID in the received communication data is the same as a group ID of the receiving indoor unit; by the receiving indoor unit, determining whether the indoor unit ID in the received communication data is the same as a master indoor unit ID prestored in the receiving indoor unit, if the master bit indicates the clear state; and by the receiving indoor unit, performing an air conditioning operation based on the operation condition in the received communication data if the indoor unit ID in the received communication data is the same as the prestored master indoor unit ID.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
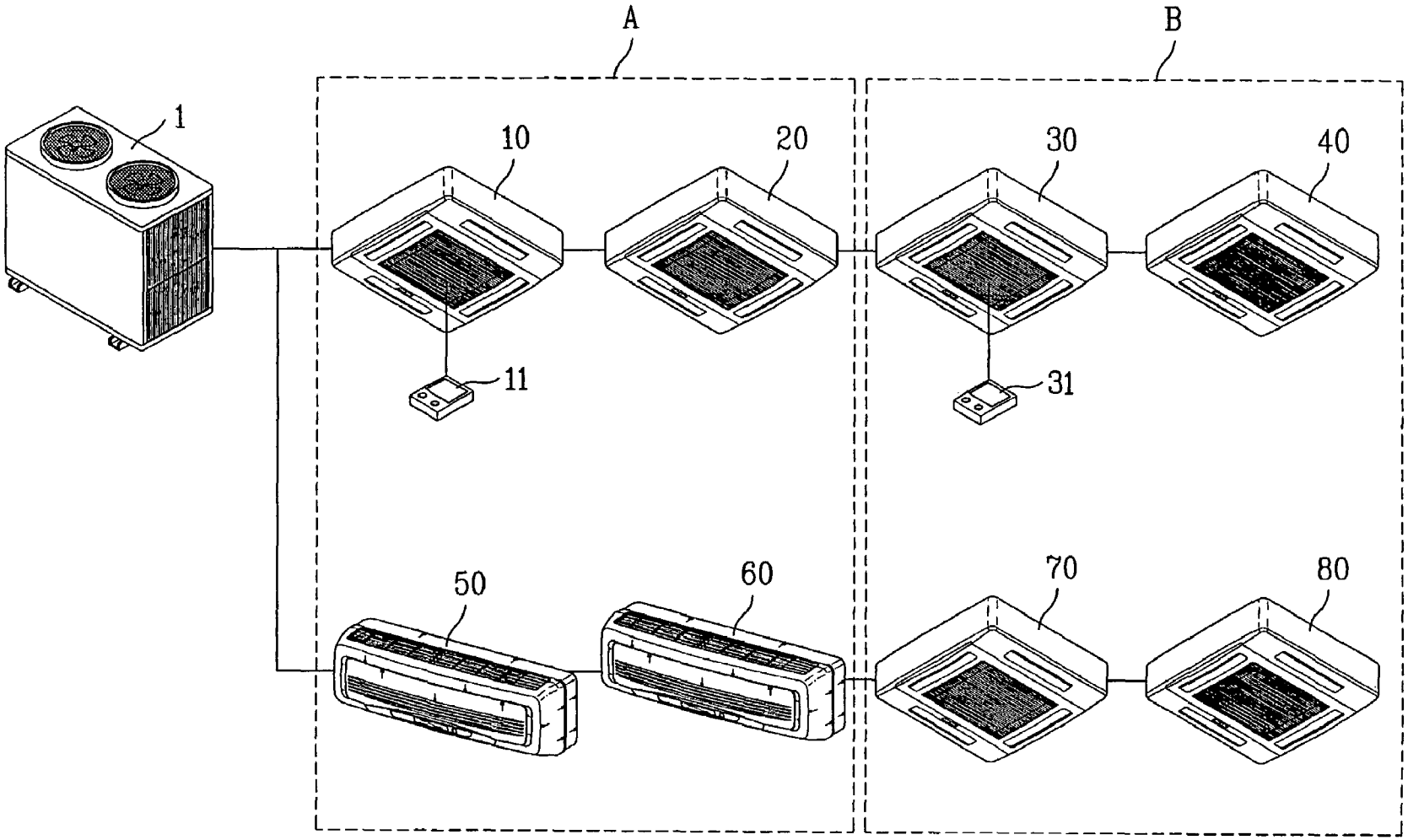
FIG. 1 is a view showing one embodiment of an indoor unit group-unit control configuration of a multi-air conditioner according to the present invention.
Figure 2:
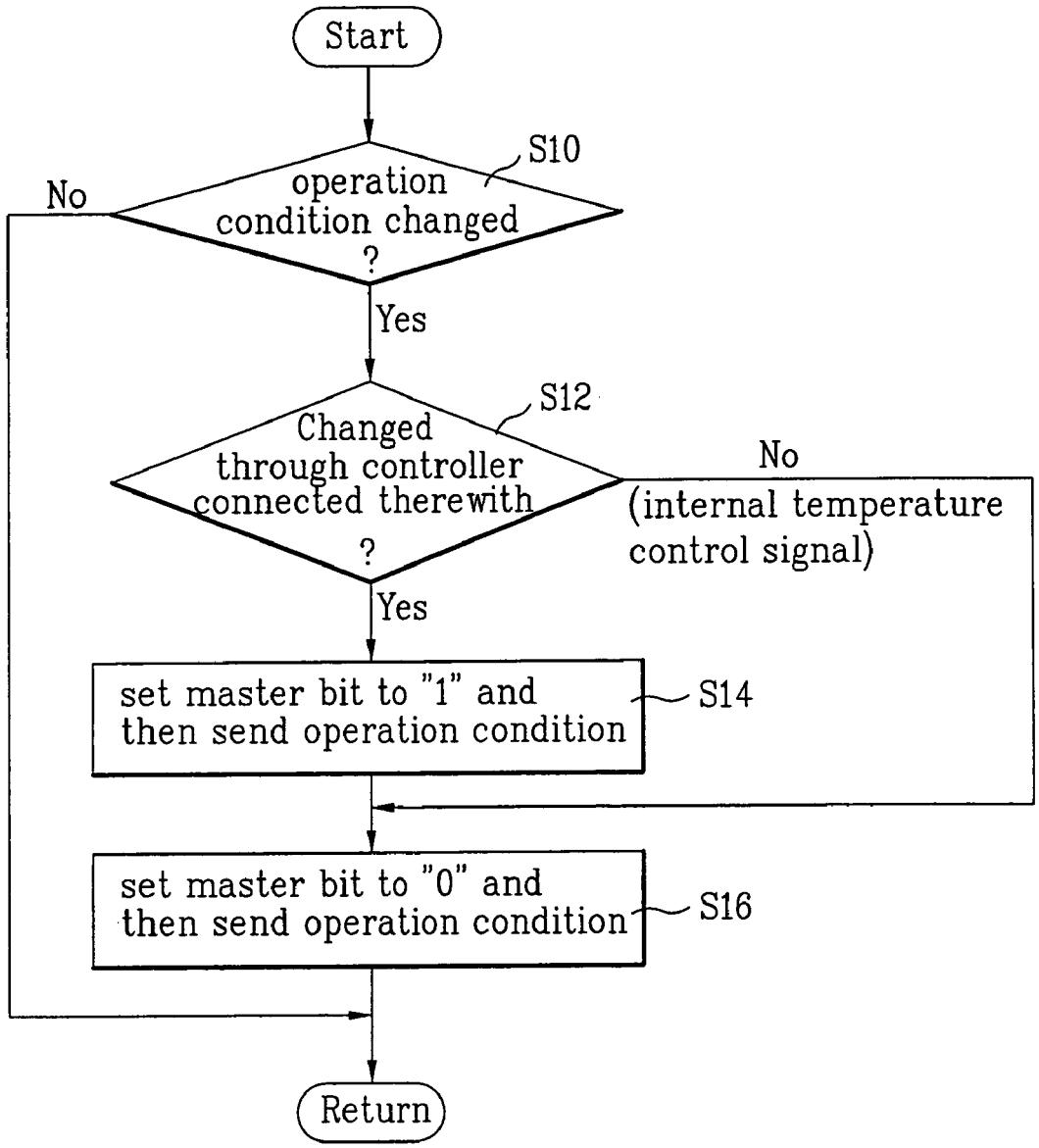
FIG. 2 is a flow chart illustrating an inter-indoor unit sending process in a group-unit control method of the multi-air conditioner according to the present invention.
Figure 3:
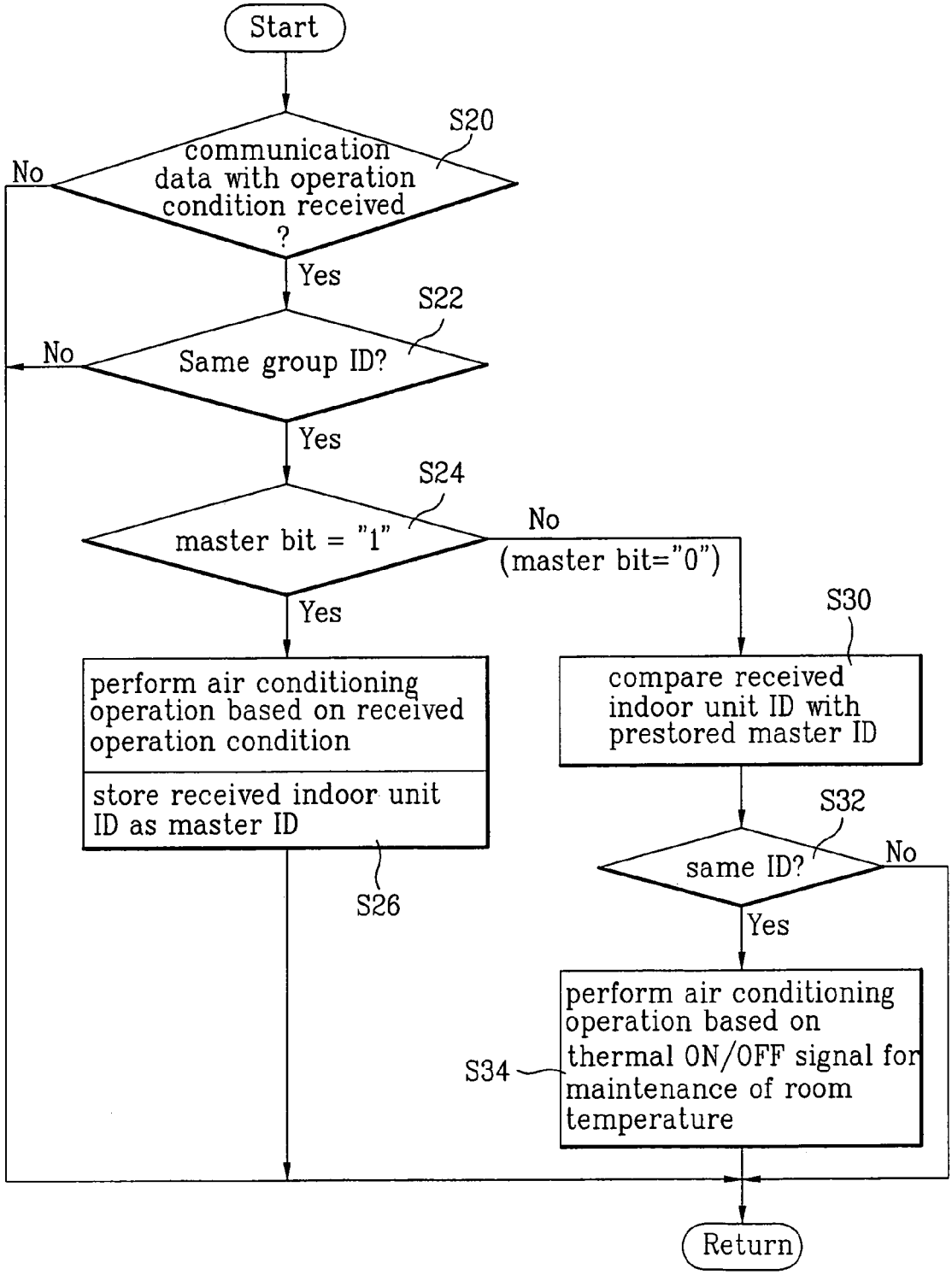
FIG. 3 is a flow chart illustrating an inter-indoor unit reception process in the group-unit control method of the multi-air conditioner according to the present invention.

FIG. 1 shows one embodiment of an indoor unit group-unit control configuration of a multi-air conditioner according to the present invention, FIG. 2 is a flow chart illustrating an inter-indoor unit sending process in a group-unit control method of the multi-air conditioner according to the present invention, and FIG. 3 is a flow chart illustrating an inter-indoor unit reception process in the group-unit control method of the multi-air conditioner according to the present invention.

First, the multi-air conditioner according to the present invention will be described with reference to FIG. 1.

As shown in FIG. 1, the multi-air conditioner according to the present invention comprises one outdoor unit 1, and a plurality of indoor units 10, 20, 50 and 60, and 30, 40, 70 and 80 connected in common to the outdoor unit 1 via a communication line for performing data communication with the outdoor unit 1. The indoor units 10, 20, 50 and 60, and 30, 40, 70 and 80 each act variably as a master and a slave and perform an air conditioning operation based on the same air conditioning operation conditions on a group basis.

In the multi-air conditioner, the outdoor unit 1 and each of the indoor units 10, 20, 50 and 60, and 30, 40, 70 and 80 continuously perform data communication with each other to send and receive information to/from each other.

Each of the indoor units 10, 20, 50 and 60, and 30, 40, 70 and 80 has its own unique identification (ID) (referred to hereinafter as an 'indoor unit ID'). Thus, the indoor units 10, 20, 50 and 60, and 30, 40, 70 and 80 perform data communication in such a manner that, if the outdoor unit 1 sends data containing a specific indoor unit ID, then only one of the indoor units corresponding to the specific indoor unit ID responds to the sent data.

According to the present invention, the indoor units 10, 20, 50 and 60, and 30, 40, 70 and 80 are configured to share data with one another in a similar manner to the data communication between the outdoor unit 1 and each indoor unit. With this configuration, the operation conditions of a specific one of the indoor units can be received by all the other indoor units.

The indoor units 10, 20, 50 and 60, and 30, 40, 70 and 80 each act variably as a master and a slave through inter-indoor unit data communication to enable a group-unit operation control.

In other words, one of the indoor units whose air conditioning operation condition has been changed acts as a master that sends the changed operation condition according to a predefined communication protocol. Each of the indoor units other than the master indoor unit acts as a slave that receives the operation condition from the master indoor unit and performs an air conditioning operation based on the received operation condition if it belongs to the same group as that of the master indoor unit.

For the group-unit operation control, the indoor units 10, 20, 50 and 60, and 30, 40, 70 and 80 each include a group designator (not shown) for assigning a group ID to the corresponding indoor unit.

Here, the group designator may employ an input unit, such as a rotary switch, a dip switch, etc., to input an ID of a specific one of the several groups to the corresponding indoor unit.

A wired/wireless controller 11 or 31 may be individually installed for each of the indoor units 10, 20, 50 and 60, and 30, 40, 70 and 80 to allow the user to personally input or change the air conditioning operation conditions.

It is preferable that the wired/wireless controller 11 or 31 is installed for at least one indoor unit in the same group.

In the present invention, even though only one indoor unit in each group A or B including a plurality of indoor units is connected with the wired/wireless controller 11 or 31, it is possible to control all the indoor units in the same group through inter-indoor unit data communication.

Next, a detailed description will be given of the indoor unit group-unit control method of the multi-air conditioner with the above-stated configuration according to the present invention.

First, the indoor units 10, 20, 50 and 60, and 30, 40, 70 and 80 are set respectively to group IDs so that the air conditioning operations thereof can be controlled on a group basis.

For example, it is assumed that the indoor units 10, 20, 50 and 60 are set as a group "A" and the indoor units 30, 40, 70 and 80 are set as a group "B".

Thereafter, any one of the indoor units 10, 20, 50 and 60 is manipulated to control the group "A" and any one of the indoor units 30, 40, 70 and 80 is manipulated to control the group "B".

That is, with only one indoor unit manipulated in a group, it is possible to control all indoor units in the same group according to the same operation conditions through inter-indoor unit data communication, which will hereinafter be described in more detail in connection with an inter-indoor unit sending process of FIG. 2 and an inter-indoor unit reception process of FIG. 3.

The inter-indoor unit sending process of the multi-air conditioner according to the present invention will hereinafter be described with reference to FIG. 2.

As shown in FIG. 2, when an air conditioning operation condition of a specific indoor unit has been changed (S10), the specific indoor unit determines whether the operation condition has been changed through a wired/wireless controller connected therewith or the operation condition is an internal temperature control signal (S12).

Here, the internal temperature control signal is a thermal ON/OFF signal to repeatedly turn a compressor on/off so as to maintain the room temperature at a predetermined temperature during the air conditioning operation of the indoor unit.

Upon determining at step S12 that the operation condition has been changed through the wired/wireless controller, the specific indoor unit sends the changed operation condition to all the other indoor units according to a predefined communication protocol.

Here, the format of the communication protocol includes the sender's indoor unit ID and group ID, the changed operation condition, and a master bit indicative of the operation condition change.

That is, if the air conditioning operation condition is changed by the user, the specific indoor unit sets the master bit to "1" and then sends, to all the other indoor units, communication data composed of its indoor unit ID and group ID, the changed operation condition and the master bit (S14).

The specific indoor unit then clears the master bit (i.e., master bit=0) after sending the communication data a predetermined number of times (for example, two times).

On the other hand, when, at step S12, the operation condition is determined not to have been changed through the wired/wireless controller, but to be the internal temperature control signal, the specific indoor unit sets the master bit to "0" and then sends, to all the other indoor units, communication data composed of its indoor unit ID and group ID, the changed operation condition and the master bit (S16).

In this manner, the specific indoor unit whose air conditioning operation condition has been changed acts as a master that sends the operation condition thereof to the other indoor units.

Moreover, the specific indoor unit sets the master bit to "1" if the operation condition is changed by the user and to "0" if the operation condition is the thermal ON/OFF signal for maintenance of the room temperature, thereby making it possible to distinguish the changed operation condition between the operation condition changed by the user and the thermal ON/OFF signal.

The inter-indoor unit reception process of the multi-air conditioner according to the present invention will hereinafter be described on the basis of the above-stated sending process.

As shown in FIG. 3, a specific indoor unit determines whether communication data sent from a different indoor unit has been received through inter-indoor unit data communication (S20).

Here, the received communication data is composed of a sender's indoor unit ID, group ID and air conditioning operation condition, and a master bit according to the aforementioned communication protocol format.

If the communication data sent from the different indoor unit is determined to have been received at step S20, the specific indoor unit determines whether the group ID of the sending indoor unit is the same as a group ID thereof (S22).

Upon determining at step S22 that the group ID of the sending indoor unit is not the same as the group ID of the specific indoor unit, the specific indoor unit discards the received communication data.

On the other hand, in the case where the group ID of the sending indoor unit is determined to be the same as the group ID of the specific indoor unit at step S22, the specific indoor unit reads the master bit in the received communication data.

The specific indoor unit then determines whether the master bit is "1" or "0" (S24). Namely, the specific indoor unit determines whether the operation condition received from the sending indoor unit is an operation condition inputted/changed by the user or an internal temperature control signal.

Upon determining at step S24 that the received operation condition is the operation condition inputted/changed by the user, the specific indoor unit performs an air conditioning operation based on the received operation condition (S26).

Also at step S26, the specific indoor unit stores the received sender's indoor unit ID as a master ID.

Therefore, if the operation condition of an indoor unit is changed by the user, the indoor unit acts as a master to send the operation condition thereof to all the other indoor units. At this time, the other indoor units in the same group perform an air conditioning operation based on the same operation condition as that of the master.

On the other hand, in the case where, at step S24, the received operation condition is determined not to be the operation condition inputted/changed by the user, but to be the internal temperature control signal, the specific indoor unit compares the received sender's indoor unit ID with a master ID prestored therein to determine whether they are the same (S30 and S32).

If it is determined at step S32 that the received sender's indoor unit ID is not the same as the prestored master ID, the specific indoor unit discards the received communication data.

On the other hand, if the received sender's indoor unit ID is determined to be the same as the prestored master ID at step S32, the specific indoor unit applies the received operation condition as a thermal ON/OFF signal for maintenance of the room temperature and then performs an air conditioning operation based on the thermal ON/OFF signal (S34).

Therefore, provided that the specific indoor unit belongs to the same group as that of the master indoor unit, it performs an air conditioning operation based on the operation condition received from the master indoor unit.

As apparent from the above description, the present invention has effects as follows.

Firstly, a plurality of indoor units can be more efficiently controlled on a group basis through inter-indoor unit data communication.

Secondly, the indoor units can be controlled on a group basis irrespective of the wiring of a controller, so that the group-unit control is not restricted by whether the controller is used or not.

Thirdly, it is easy to add or change an object to which the group-unit control is to be applied.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A multi-air conditioner comprising:

one outdoor unit; and a plurality of indoor units connected in common to the outdoor unit via a communication line for performing data communication with the outdoor unit, each of the indoor units acting variably as a master indoor unit and a slave indoor unit and performing an air conditioning operation based on the same air conditioning operation conditions on a group basis, wherein an indoor unit acting as the master indoor unit transmits an operational condition and a master bit, the master bit indicating whether the operational condition results from:

an input or change made by a user, or an internal control signal.

2. The multi-air conditioner as set forth in claim 1, wherein the indoor units are adapted to share data sent and received between the outdoor unit and each of the indoor units so that air conditioning operation conditions of a specific one of the indoor units can be received by all the other indoor units.

3. The multi-air conditioner as set forth in claim 1, wherein the indoor units include:

an indoor unit acting as the master indoor unit if an air conditioning operation condition thereof is changed, the master indoor unit sending the changed operation condition according to a predefined communication protocol; and slave indoor units for receiving the operation condition sent from the master indoor unit through data communication with the master indoor unit and performing an air conditioning operation based on the received operation condition on a group basis.

4. The multi-air conditioner as set forth in claim 1, wherein each of the indoor units includes a controller through which a user can personally input the air conditioning operation conditions to a corresponding one of the indoor units.

5. The multi-air conditioner as set forth in claim 1, wherein each of the indoor units includes a wired/wireless controller through which a user can personally input the air conditioning operation conditions to a corresponding one of the indoor units.

6. The multi-air conditioner as set forth in claim 1, wherein the indoor units are grouped into a plurality of groups, each of the groups including at least one indoor unit having a controller through which a user can personally input the air conditioning operation conditions to the indoor unit.

7. The multi-air conditioner as set forth in claim 1, wherein the indoor units are grouped into a plurality of groups, each of the groups including at least one indoor unit having a wired/wireless controller through which a user can personally input the air conditioning operation conditions to the indoor unit.

8. The multi-air conditioner as set forth in claim 1, wherein each of the indoor units includes a group designator for assigning a group identification (ID) to a corresponding one of the indoor units so that the corresponding indoor unit can be controlled on a group basis.

9. The multi-air conditioner as set forth in claim 1, wherein each of the indoor units includes a rotary switch for selecting a group ID for a corresponding one of the indoor units so that the corresponding indoor unit can be controlled on a group basis.

10. The multi-air conditioner as set forth in claim 1, wherein each of the indoor units includes a dip switch for selecting a group ID for a corresponding one of the indoor units so that the corresponding indoor unit can be controlled on a group basis.

11. A group-unit control method of a multi-air conditioner, the multi-air conditioner including one outdoor unit, and a plurality of indoor units connected in common to the outdoor unit for performing data communication with the outdoor unit, the method comprising the steps of:

a) grouping the indoor units into a plurality of groups;

b) if an air conditioning operation condition of a specific one of the indoor units is changed, sending, by the specific indoor unit, the changed operation condition to all the other indoor units according to a predefined communication protocol; and c) by each of the indoor units, receiving an air conditioning operation condition sent from a different one of the indoor units in the same group and performing an air conditioning operation based on the received operation condition, wherein step b) includes the step of by the specific indoor unit, recognizing itself as a master indoor unit if the operation condition thereof is changed by a user, and then sending communication data to all the other indoor units, the communication data including an indoor unit ID and group ID of the specific indoor unit, the changed operation condition, and a master bit indicative of the operation condition change.

12. The group-unit control method as set forth in claim 11, wherein the step a) includes the step of setting the indoor units to group IDs, respectively, so that the indoor units can be controlled on a group basis.

13. The group-unit control method as set forth in claim 11, wherein the predefined communication protocol has a format including an indoor unit ID and group ID of the sending indoor unit, an air conditioning operation condition of the sending indoor unit, and a master bit indicative of whether the operation condition of the sending indoor unit has been changed.

14. The group-unit control method as set forth in claim 11, wherein the step b) further includes the step of: by the specific indoor unit, clearing the master bit after sending the communication data a predetermined number of times.

15. A group-unit control method of a multi-air conditioner, the multi-air conditioner including one outdoor unit, and a plurality of indoor units connected in common to the outdoor unit for performing data communication with the outdoor unit, the method comprising the steps of:

a) grouping the indoor units into a plurality of groups;

b) if an air conditioning operation condition of a specific one of the indoor units is changed, sending, by the specific indoor unit, the changed operation condition to all the other indoor units according to a predefined communication protocol; and c) by each of the indoor units, receiving an air conditioning operation condition sent from a different one of the indoor units in the same group and performing an air conditioning operation based on the received operation condition, wherein the step b) includes the step of if the operation condition of the specific indoor unit is internally changed during an air conditioning operation of the specific indoor unit, sending, by the specific indoor unit, communication data to all the other indoor units, the communication data including an indoor unit ID and group ID of the specific indoor unit, the changed operation condition, and a master bit indicative of a clear state.

16. A group-unit control method of a multi-air conditioner, the multi-air conditioner including one outdoor unit, and a plurality of indoor units connected in common to the outdoor unit for performing data communication with the outdoor unit, the method comprising the steps of:

a) grouping the indoor units into a plurality of groups;

b) if an air conditioning operation condition of a specific one of the indoor units is changed, sending, by the specific indoor unit, the changed operation condition to all the other indoor units according to a predefined communication protocol; and c) by each of the indoor units, receiving an air conditioning operation condition sent from a different one of the indoor units in the same group and performing an air conditioning operation based on the received operation condition, wherein the step c) includes the steps of: by the receiving indoor unit, receiving communication data including an indoor unit ID and group ID of the sending indoor unit, a changed air conditioning operation condition of the sending indoor unit, and a master bit indicative of the operation condition change; and by the receiving indoor unit, performing an air conditioning operation based on the operation condition in the received communication data if the group ID in the received communication data is the same as a group ID of the receiving indoor unit and the master bit indicates the operation condition change.

17. A group-unit control method of a multi-air conditioner, the multi-air conditioner including one outdoor unit, and a plurality of indoor units connected in common to the outdoor unit for performing data communication with the outdoor unit, the method comprising the steps of:

a) grouping the indoor units into a plurality of groups;

b) if an air conditioning operation condition of a specific one of the indoor units is changed, sending, by the specific indoor unit, the changed operation condition to all the other indoor units according to a predefined communication protocol; and c) by each of the indoor units, receiving an air conditioning operation condition sent from a different one of the indoor units in the same group and performing an air conditioning operation based on the received operation condition, wherein the step c) includes the steps of: by the receiving indoor unit, receiving communication data including an indoor unit ID and group ID of the sending indoor unit, a changed air conditioning operation condition of the sending indoor unit, and a master bit indicative of the operation condition change; and by the receiving indoor unit, storing the indoor unit ID in the received communication data as a master indoor unit ID if the group ID in the received communication data is the same as a group ID of the receiving indoor unit and the master bit indicates the operation condition change, and then performing an air conditioning operation based on the operation condition in the received communication data.

18. A group-unit control method of a multi-air conditioner, the multi-air conditioner including one outdoor unit, and a plurality of indoor units connected in common to the outdoor unit for performing data communication with the outdoor unit, the method comprising the steps of:

a) grouping the indoor units into a plurality of groups;

b) if an air conditioning operation condition of a specific one of the indoor units is changed, sending, by the specific indoor unit, the changed operation condition to all the other indoor units according to a predefined communication protocol; and c) by each of the indoor units, receiving an air conditioning operation condition sent from a different one of the indoor units in the same group and performing an air conditioning operation based on the received operation condition, wherein the step c) includes the steps of: by the receiving indoor unit, receiving communication data including an indoor unit ID and group ID of the sending indoor unit, a changed air conditioning operation condition of the sending indoor unit, and a master bit indicative of a clear state; by the receiving indoor unit, determining whether the master bit indicates the clear state, if the group ID in the received communication data is the same as a group ID of the receiving indoor unit; by the receiving indoor unit, determining whether the indoor unit ID in the received communication data is the same as a master indoor unit ID prestored in the receiving indoor unit, if the master bit indicates the clear state; and by the receiving indoor unit, performing an air conditioning operation based on the operation condition in the received communication data if the indoor unit ID in the received communication data is the same as the prestored master indoor unit ID.

* * * * *